United States Patent [19]

Sell

[11] 4,213,649

[45] Jul. 22, 1980

[54] DRINK CONTAINER HOLDER

[76] Inventor: Sanford S. Sell, 1632 Holmes Ave., Racine, Wis. 53405

[21] Appl. No.: 961,616

[22] Filed: Nov. 17, 1978

[51] Int. Cl.[2] ..... A47C 7/62

[52] U.S. Cl. ..... 297/189; 248/226.5; 248/311.2

[58] Field of Search ..... 297/188, 189, 194, 417; 248/226.5, 311.1 R

[56] References Cited

U.S. PATENT DOCUMENTS

| | | | |
|---|---|---|---|
| 155,107 | 9/1874 | Richardson | 297/189 X |
| 2,979,120 | 4/1961 | Amburn | 297/188 |
| 3,029,105 | 4/1962 | Junkunc | 297/189 |
| 3,125,372 | 3/1964 | Rose | 297/188 |
| 3,367,714 | 2/1968 | Stone | 297/194 |
| 3,370,820 | 2/1968 | Liss et al. | 248/311 |
| 4,063,701 | 12/1977 | Wray | 297/188 X |

*Primary Examiner*—Roy D. Frazier
*Assistant Examiner*—Peter A. Aschenbrenner
*Attorney, Agent, or Firm*—Arthur J. Hansmann

[57] ABSTRACT

An item supporter for a chair and being releasably attachable to the chair for holding items such as drinks or the like. A foldable or lawn type of chair is preferrable, and the supporter has a support member with openings therein for receiving drink glasses or the like, and a lower shelf supports the items. Two spring clips are affixed to the support member and snap on to the chair legs, and the clips will pivot to align with the chair legs and thus present the support member in a horizontal position, and the clips also slide along the chair legs so that the supporter remains attached to the chair if and when the chair is folded and it need not be removed from the chair.

7 Claims, 7 Drawing Figures

FIG. 1
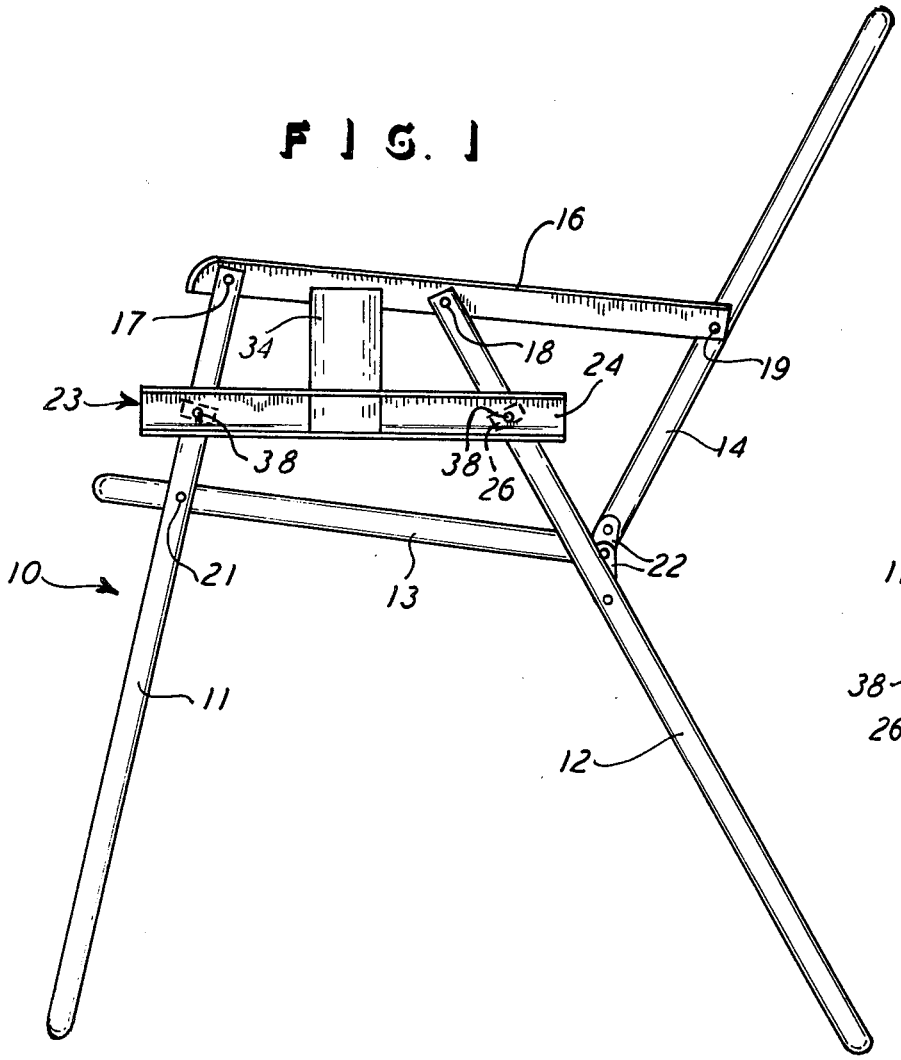
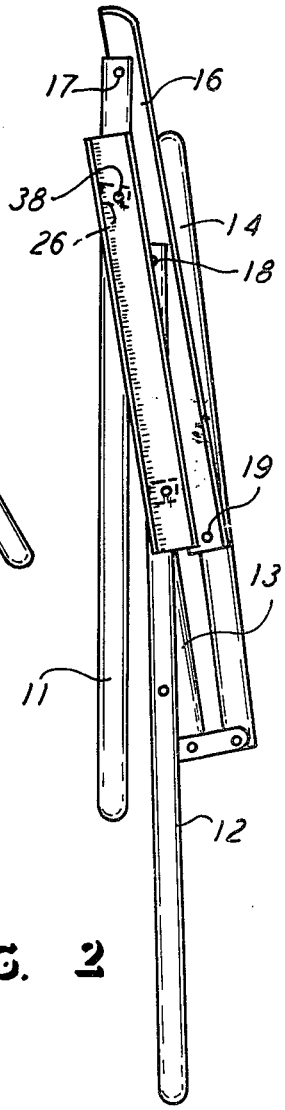
FIG. 2
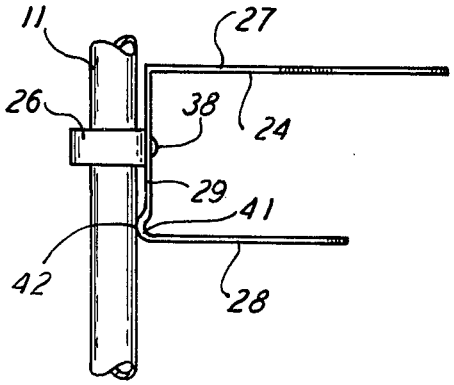
FIG. 7

FIG. 3
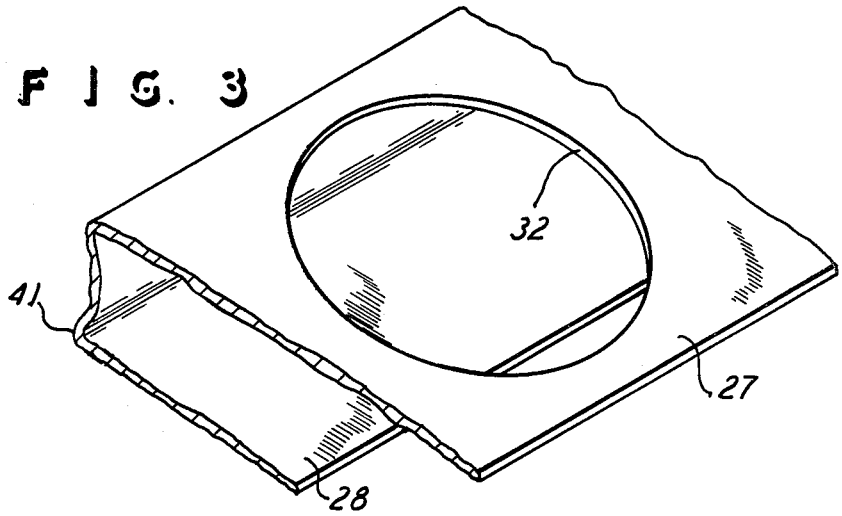
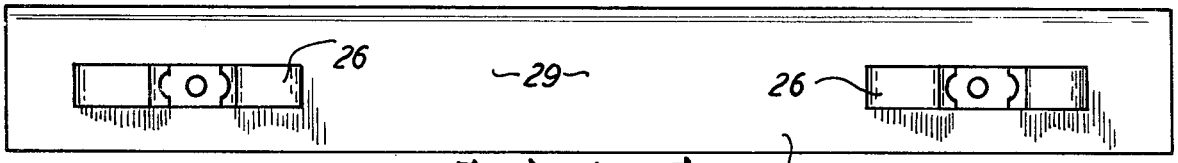
FIG. 5
FIG. 4
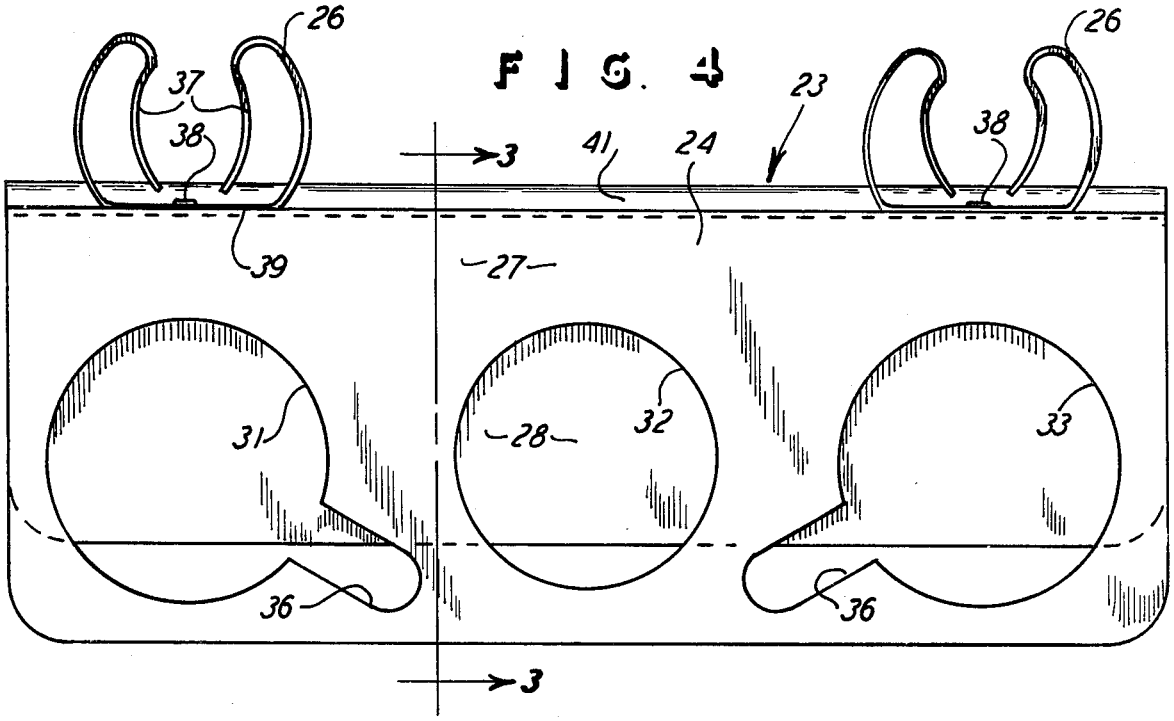
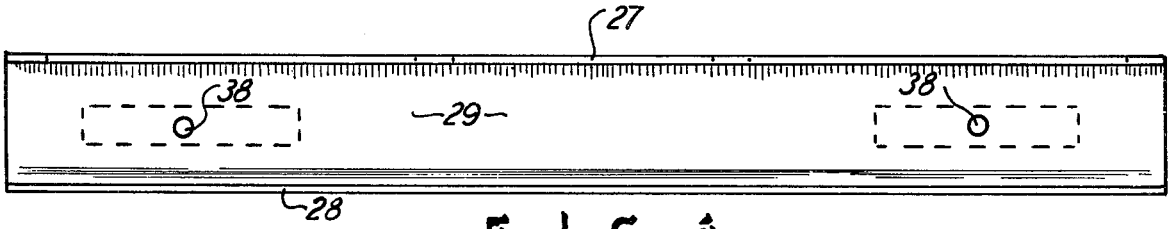
FIG. 6

DRINK CONTAINER HOLDER

This invention relates to an item supporter for a chair, and, more particularly, it relates to a drink holder for a folding piece of lawn furniture.

BACKGROUND OF THE INVENTION

The prior art is already aware of item supporters or drink holders attachable to furniture or the like, such as lawn furniture. Examples of prior art are found in U.S. Pat. Nos. 2,544,817, 3,021,106, 3,239,272, 3,370,820, and 3,463,436.

The prior art is limited to support members which generally utilize only a single clip or connector for attaching the holder to a chair or the like, and they do not disclose the arrangement of spring clips which align with the furniture legs or other supports, nor do they disclose holders which have special provisions for receiving and supporting drink glasses or coffee mugs or the like, and, still further, they do not have arrangements for maintaining the holder in a level but cantilever manner. Another specific difference and distinction with the prior art is that the prior art does not have a holder which is supported on two legs or at two different points along the holder and yet be self-aligning with the chair legs to which it is attached and to also be arranged so that it can remain with the chair in the event that the chair is a folded type and is actually in the folded position.

Accordingly, the present invention improves upon the prior art and provides a supporter or item holder which avoids the aforesaid deficiencies and presents a structure which is an overall improvement in the respects mentioned above. Specifically, the supporter or holder of this invention is readily and easily attached to a supporting object, such as foldable lawn furniture, and the connecting members, such as spring clips, are self-aligning with the angled legs of the lawn furniture or the like so that the support member or shelf can be horizontally disposed as desired and in a readily accomplishable manner. Still further, the supporter or item holder of this invention can be utilized with folding furniture, such as lawn furniture, and it need not be removed from the furniture when the furniture is folded. In actual practice, the supporter or item holder utilizes spring clips which attach to the furniture legs and can slide therealong when the furniture is folded so that one need not even touch or adjust or in any way maneuver or provide for the supporter or item holder when the lawn furniture is being folded.

Still further, the supporter or item holder of this invention provides for means for a stable and secure positioning of the holder member itself and in a cantilever or outboard fashion relative to lawn furniture or the like, and the supporter or item holder is therefore sufficiently secure to remain in a stable and horizontally projecting position for supporting liquid containers such as glasses and cups.

Other objects and advantages will become apparent upon reading the following description in light of the accompanying drawings.

BRIEF DESCRIPTION OF THE DRAWINGS

FIG. 1 is a side elevational view of a foldable chair with the supporter of this invention attached thereto.

FIG. 2 is a side elevational view of FIG. 1 but showing the chair in the folded position.

FIG. 3 is a sectional view, viewed substantially along the line 33 of FIG. 4, and showing the central portion of the supporter of this invention.

FIGS. 4, 5, and 6 are top, rear, and front views, respectively, of the supporter of this invention.

FIG. 7 is an end elevational view of the supporter of this invention and showing it attached to a tubular piece, such as a chair leg.

DETAILED DESCRIPTION OF THE PREFERRED EMBODIMENT

FIGS. 1 and 2 show a foldable chair, generally designated 10, and having the usual tubular front legs 11, rear legs 12, seat 13, and back 14. The chair is also shown to have the usual arm rest 16 which is pivotally attached to the legs 11 and 12 and the back 14 by means of the usual rivets 17, 18, and 19, respectively. It will also be seen and understood that the front leg 11 and seat 13 are pivotally connected by means of the pin or the like 21, and links 22 also connect the rear leg 12 and the seat 13 and back 14. Therefore, the chair 10 is of a conventional arrangement and is shown to be a foldable type of lawn furniture, and further display or description of the chair need not be given for one to understand the invention disclosed herein.

FIGS. 1 and 2 further show that the supporter or item holder of this invention is generally designated 23 and it consists of a holder member 24 and two fasteners in the form of spring clips 26. The holder member 24 is shown to be in the form of a channel and has an upper horizontal portion 27 and a lower horizontal portion 28 and an intermediate and upright portion 29, with all those three portions being one continuous piece or integral and presenting a C-shape, such as shown in FIGS. 3 and 7. It will be further seen that the upper horizontal portion 27 is of a width, as viewed in FIG. 7, greater than that of the lower horizontal portion 28, and also the upper horizontal portion has openings 31, 32, and 33 extending therethrough, as shown in FIGS. 3 and 4.

Therefore, as shown in FIG. 1, a drink glass or the like 34 can be received in the circular opening 32, and the glass will extend through the upper portion 27 and will be supported by or rest upon the lower horizontal portion 28. In a similar manner, other cylindrically-shaped glasses or coffee or like drink mugs or containers can be recieved in the openings 31 and 33, and those openings have branches 36 for receiving the mug or container handle and thus permit the mug or container to extend through the upper portion 27 and rest on the lower portion 28, if desired and if the mug be of a sufficient shape to do so. Otherwise, the container in the openings 31 and 33 may be in the nature of a coffee cup and simply extend through those openings 31 and 33 and have the cup handle extend into the branch openings 36, all in an understandable manner though no actual mug or cup is shown herein.

The fasteners 26 are in the form of conventional spring clips which have legs 37 extending inwardly and adjacent each other, and those legs contact the chair legs 11 and 12 and snap thereon and are spring-urged against the legs 11 and 12 for holding the supporter or item holder relative to the chair 10. Fasteners 38, in the form of conventional rivets, extend through the spring clip base portion 39 and through the holder member upright portion 29 to thereby pivotally secure the fasteners 26 to the holder member 24. That is, the spring clips 26 can pivot about the respective axis of the rivets 38, but the spring clip base portion 39 will remain parallel to and in contact with the holder member upright portion 29. For further explanation, it will be seen and understood that the spring clips 26 pivot to have there legs 37 align with the respective chair legs 11 and 12 for a coaxial arrangement between the spring clips 26 and the chair legs 11 and 12, such as in the FIG. 1 position for the supporter or item holder 23. Thus, FIG. 1 shows the spring clips 26 angled relative to the holder member 24, but those clips 26 are then coaxially aligned with the respective legs 11 and 12, as shown in FIG. 1. The spring clips 26 are of conventional design, but they are pivotally attached by means of the rivets 38, as described and shown and as mentioned above. Accordingly, the supporter 23 is self-aligning relative to the chair 10 and specifically relative to the chair legs 11 and 12, and thus the holder member 24 is placed in the horizontal position which is the desired orientation for supporting liquid containers such as the glass 34.

To assure stability and horizontal orientation in the horizontal direction away from the chair legs 11 and 12, such as shown in FIG. 7, the holder member 24 is provided with an offset portion 41 which extends in the direction away from the interior of the C-shape of the member 24 to thus abut the chair leg at the location designated 42 in FIG. 7. That is, the offset 41 is extending in the direction opposite from the extent of the horizontal portions 27 and 28, at least relative to the upright portion 29, and it is below the elevation of the fasteners 26 to thus abut the legs 11 and 12 and provide for stability and the horizontal orientation in the direction mentioned.

Still another feature of this arrangement is that the spring clips 26 are arranged to generally conform to the cross-sectional configuration of the legs 11 and 12, in the instance shown that is a circular configuration, and thus the clips 26 can readily slide along the legs 11 and 12 when sufficient force is applied to the spring clips 26, such as when the chair 10 is being placed into the folded position of FIG. 2. With that arrangement, the supporter 23 need not be removed from the chair 10 when the chair is to be folded. Thus, the supporter 23 is in the nature of a permanent part of the chair 10 but is actually articulated relative to the chair 10 so that it will fold therewith by having the spring clips 26 move along the respective legs 11 and 12 to adjust to the folded position and to also adjust to the horizontal position shown and described in connection with FIG. 1.

In this arrangement, the members 22 are fasteners, in the form of spring clips, and they include a clamp means, particularly the ends or legs 37 which clamp onto the chair legs 11 and 12, as shown and described. As such, the supporter or item holder 23 can be readily attached to or readily removed from the chair, and it can also remain with the chair when the chair is placed in the folded position of FIG. 2. Still further, the holder member 24 can receive and stabily support various liquid containers having different shapes, including stemmed glasses where the base and stem can project through any one of the openings 31, 32, or 33 and the base can rest upon the lower horizontal portion 28. As such, the holder member 24 has its upper portion 27 which horizontally restrains an item, such as a liquid container, and the lower portion 28 vertically supports that item and thus serves as a shelf while the upper portion 27 serves as a guide or stabilizer. Thus, the holder 23 is constructed of a plate-like material disposed in the C-shape and having the plurality of openings in the upper planar section or plate 27. The lower plate 28 extends parallel to the upper plate 27, and the two are joined by the upright portion 29 with the offset portion 41 at the juncture between the portions 28 and 29. Thus, the upper plate 27 also provides a flat shelf support on which items can be laid, such as newspapers or small magazines.

What is claimed is:

1. An item supporter for a chair having two spaced-apart legs on a side thereof, comprising an item support member including a horizontal portion for supporting items thereon and including an upright portion, two fasteners spaced apart on said upright portion and being pivotally connected thereto by a rivet for pivotal movement of each of said fasteners about the axis of its said rivet, said fasteners including clamp means for attaching to each of said chair legs and have said item support member extend away from said chair legs with said horizontal portion horizontally disposed, said item support member being C-shaped in end view to present an additional horizontal portion disposed above the first-mentioned said horizontal portion and with said upright portion extending between said horizontal portions, and said additional horizontal portion having openings therein for receiving said items extending therethrough and being supported on the first-mentioned said horizontal portion.

2. An item supporter for a chair having two spaced-apart legs on a side thereof, comprising an item support member including a horizontal portion for supporting items thereon and including an upright portion, two fasteners spaced apart on said upright portion and being pivotally connected thereto by a rivet for pivotal movement of each of said fasteners about the axis of its said rivet, said fasteners including clamp means for attaching to each of said chair legs and have said item support member extend away from said chair legs with said horizontal portion horizontally disposed, said upright portion including an offset section extending underneath said fasteners and away from said horizontal portion to engage said chair legs and thereby stabilize said supporter on said chair.

3. The item supporter as claimed in claim 1 or 2, wherein said two fasteners are spring clips for attaching to said chair legs.

4. The item supporter as claimed in claim 1 or 2, including a foldable chair, and wherein said two fasteners are spring clips for attaching to said chair legs, and said spring clips are slidable along said chair legs for adjustment therealong and when said chair is being folded so that said supporter need not be removed from said chair.

5. The item supporter as claimed in claim 1, wherein said item support member is of a flat plate construction and presents said horizontal portions as flat shelves, and said additional horizontal portion has a plurality of openings therein for receiving liquid containers which extend through said openings and rest on the first-mentioned said horizontal portion.

6. The item supporter as claimed in claim 5, wherein said item support member includes an offset section at the juncture between said first-mentioned horizontal portion and said upright portion to have said juncture abut the chair legs and thereby stabilize said supporter on said chair.

7. An item supporter for a foldable chair comprising an arm rest and two spaced-apart tubular front and rear legs on a side thereof and with said legs being pivoted to said arm rest at spaced-apart points therealong, an item support member including a horizontal portion for supporting items thereon and including an upright portion, two spring clip fasteners spaced apart on said upright portion and being pivotally connected thereto by a rivet for pivotal movement of each of said fasteners about the axis of its said rivet, said fasteners including clamp means for attaching to each of said chair legs and have said item support member extend away from said chair legs with said horizontal portion horizontally disposed, said spring clips having openings faced away from said upright portion and faced inwardly from the side of said chair to attach thereto by moving laterally of said chair and having said clamp means extend across said leg and thus across the plane of folding movement of said leg and being slidable along said chair legs when said chair is being folded so that said supporter need not be removed from said chair.

* * * * *